US008596838B2

(12) United States Patent
Fancello et al.

(10) Patent No.: US 8,596,838 B2
(45) Date of Patent: Dec. 3, 2013

(54) OPTICS SUPPORT STRUCTURES WITH TAPERED WALLS

(75) Inventors: Angelo Fancello, Austin, TX (US); Meagan Gonzalez Noble, Austin, TX (US); Tizhi Huang, Plano, TX (US); Mark E. Lucente, Austin, TX (US)

(73) Assignee: Zebra Imaging, Inc., Austin, TX (US)

( * ) Notice: Subject to any disclaimer, the term of this patent is extended or adjusted under 35 U.S.C. 154(b) by 0 days.

(21) Appl. No.: 12/651,413

(22) Filed: Dec. 31, 2009

(65) Prior Publication Data

US 2011/0038167 A1 Feb. 17, 2011

Related U.S. Application Data

(62) Division of application No. 12/607,018, filed on Oct. 27, 2009.

(60) Provisional application No. 61/108,551, filed on Oct. 27, 2008.

(51) Int. Cl.
*F21V 19/00* (2006.01)
*F21V 21/00* (2006.01)

(52) U.S. Cl.
USPC ..... 362/382; 362/97.1

(58) Field of Classification Search
USPC ..... 362/268, 554, 558, 559, 561, 362/97.1–97.4, 246, 382, 351; 312/223.1; 248/10.1
See application file for complete search history.

(56) References Cited

U.S. PATENT DOCUMENTS

| | | | | |
|---|---|---|---|---|
| 6,974,221 | B2 * | 12/2005 | Wu et al. | 362/29 |
| 7,520,654 | B2 * | 4/2009 | Freking et al. | 362/627 |
| 2002/0044437 | A1 * | 4/2002 | Lee | 362/31 |
| 2004/0257792 | A1 * | 12/2004 | Yu et al. | 362/31 |
| 2008/0031007 | A1 * | 2/2008 | Wu et al. | 362/607 |
| 2008/0049450 | A1 * | 2/2008 | Sampsell | 362/619 |

* cited by examiner

*Primary Examiner* — Evan Dzierzynski
*Assistant Examiner* — Danielle Allen
(74) *Attorney, Agent, or Firm* — Chowdhury & Georgakis, P.C.; Georgios A. Georgakis

(57) ABSTRACT

A display module having one or more outer walls configured to house an array of optical component stacks, where the one or more outer walls are configured to support a transparent support structure spanning the array of optical component stacks, and where an upper portion of the one or more outer walls in contact with the transparent support structure is tapered.

16 Claims, 9 Drawing Sheets

OPTICS SUPPORT STRUCTURES WITH TAPERED WALLS

I. CROSS REFERENCE TO RELATED APPLICATIONS

This application claims priority to and is a continuation of:

U.S. patent application Ser. No. 12/607,018, filed 27 Oct. 2009, entitled "Optics Support Structures" and naming Angelo Fancello, et. al, as inventor(s), which in-turn claims priority to:

U.S. Provisional Application No. 61/108,551, filed 27 Oct. 2008, entitled "Optics Support Structures" and naming Angelo Fancello, et. al, as inventor(s).

The above-referenced patents and/or patent application(s) are hereby incorporated by reference herein in their entirety.

II. GOVERNMENT CONTRACT STATEMENT

The U.S. Government has a paid-up license in this invention and the right in limited circumstances to require the patent owner to license others on reasonable terms as provided for by the terms of contract No. N61339-06-C-1065 awarded by DARPA.

III. BACKGROUND

The invention relates generally to the field of displays and more specifically to support structures for displays.

IV. SUMMARY

In one respect, disclosed is an apparatus comprising a transparent support structure having an upper surface and a lower surface, wherein the lower surface is configured to be supported by one or more outer walls of a display module, wherein the upper surface is configured to support imaging optics associated with the display module, and wherein the upper surface coincides with an imaging plane associated with the display module. The thickness of the transparent support structure is selected to permit light entering the lower surface proximate to the one or more outer walls to pass through to the upper surface and reach the outer edge of the one or more outer walls without being substantially blocked.

In another respect, disclosed is a display module comprising an optical component stack array, wherein each optical component stack within the optical component stack array comprises a delivery device and a light delivery system, wherein the delivery device is offset by a first amount from an optical axis associated with the optical component stack, and wherein the light delivery system is offset by a second amount from the optical axis.

In yet another respect, disclosed is a display module comprising one or more outer walls configured to house an array of optical component stacks, wherein the one or more outer walls are configured to support a transparent support structure spanning the array of optical component stacks, and wherein an upper portion of the one or more outer walls in contact with the transparent support structure is tapered. The display module may further comprise one or more vertical supports intermediate the array of optical component stacks, wherein the one or more vertical supports are configured to support the transparent support structure, and wherein an upper portion of the one or more vertical supports in contact with the transparent support structure is tapered.

Numerous additional embodiments are also possible.

V. BRIEF DESCRIPTION OF THE DRAWINGS

Other objects and advantages of the invention may become apparent upon reading the detailed description and upon reference to the accompanying drawings.

Figure 1:
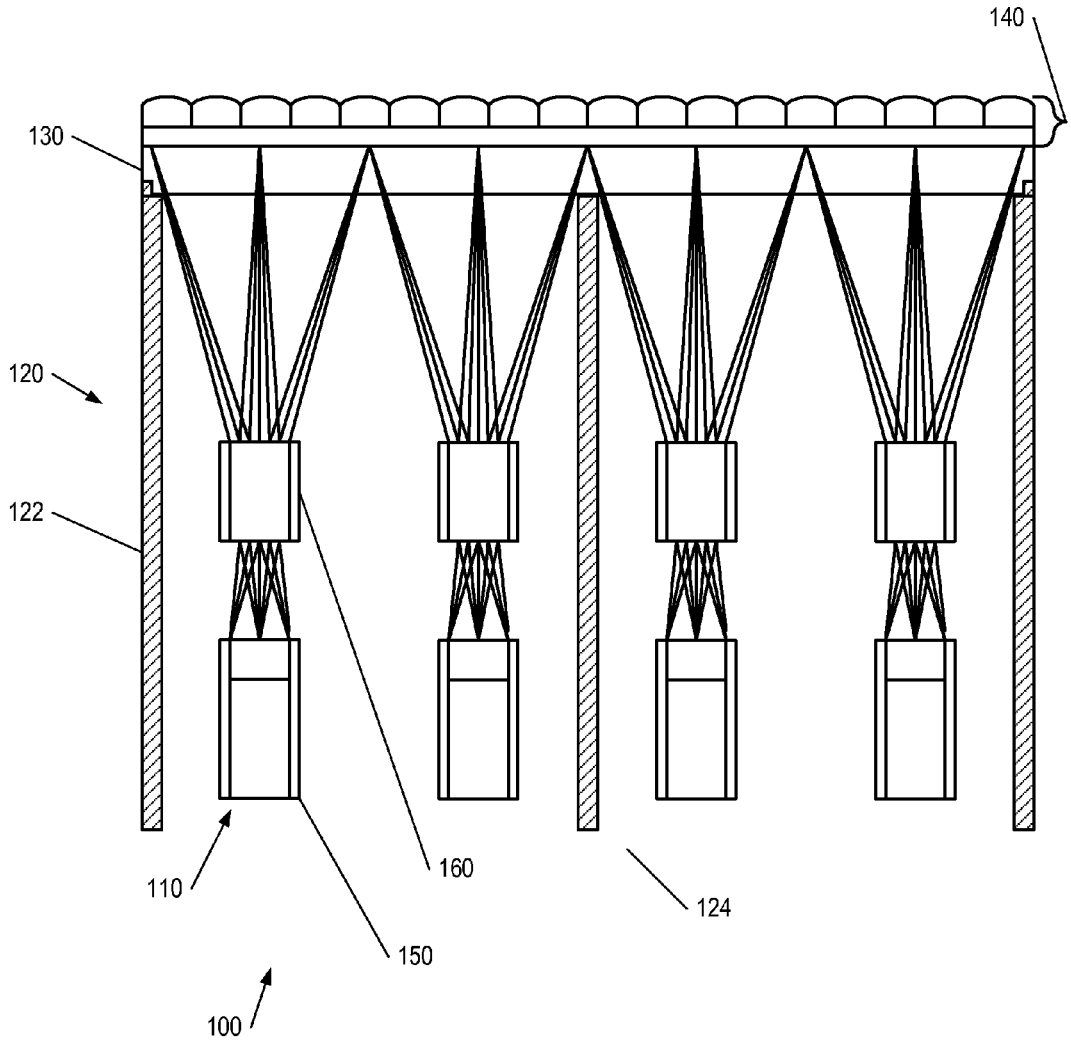
FIG. 1 is a cross-sectional representation of a display module, in accordance with some embodiments.

While the invention is subject to various modifications and alternative forms, specific embodiments thereof are shown by way of example in the drawings and the accompanying detailed description. It should be understood, however, that the drawings and detailed description are not intended to limit the invention to the particular embodiments. This disclosure is instead intended to cover all modifications, equivalents, and alternatives falling within the scope of the present invention as defined by the appended claims.

VI. DETAILED DESCRIPTION

One or more embodiments of the invention are described below. It should be noted that these and any other embodiments are exemplary and are intended to be illustrative of the invention rather than limiting. Upon reading this disclosure, many alternative embodiments of the present invention will be apparent to persons of ordinary skill in the art.

A display system may include a one or more display modules configured to receive graphics imaging data from computer processing units and display such data. In some embodiments, the display system may be a 2D projection system. In some embodiments, the display system may be a 3d display system, such as a dynamic autostereoscopic display system.

Display modules may include combinations of optical, electro-optical, and mechanical components. In some embodiments, a display module may include one or more display devices, one or more light delivery systems, and imaging optics.

Display devices may include a light source coupled to a spatial light modulator (SLM). Display devices may include emissive display devices, which generate their own light, or non-emissive display devices, which require an external light source. Emissive display devices include electroluminescent displays, field emission displays, plasma displays, vacuum fluorescent displays, carbon-nanotube displays, and polymeric displays such as organic light emitting diode (OLED) displays. Non-emissive display devices include liquid crystal displays (LCD) coupled to a backlight.

Light delivery systems are configured to receive light transmitted by the display devices and deliver this light to the imaging optics. Multiple images gathered by the light delivery systems from the display devices are presented as a single, relatively seamless image at the image plane of the imaging optics. Light delivery systems may include one or more lenses, mirrors, projector optics, or similar components. One example of a light delivery system is fiber-optic bundles as set forth in published U.S. Pat. App. 2008/0144174, which is incorporated herein by reference in its entirety. Imaging optics may include a lens array and one or more optical diffusers. The display module components may be arranged in vertical component stacks. For example, an optical component stack may include a display device optically aligned with a light delivery system.

FIG. 1 is a cross sectional view of a display module, in accordance with some embodiments. Display module 100 includes optical component stack array 110 contained within housing 120. Housing 120 includes outer walls 122. Housing 120 may also include interior vertical supports 124. Optics bridge 130 is shown supported by the upper portions of outer walls 122 and vertical supports 124. The vertical supports provide additional structural support for the optics bridge. In some embodiments, the vertical supports may be stanchions. The vertical supports may also provide some mechanical compliance between the optical bridge and the housing, which may accommodate a wider range of operating temperatures while using materials of disparate coefficients of thermal expansion.

Optics bridge 130 is a slab of transparent material (e.g., glass or PMMA) spanning optical component stack array 110. Optics bridge 130 has an upper and lower surface and sides that may be substantially aligned with outer walls 122. Optics bridge 130 is configured to support imaging optics 140. Imaging optics 140 may include a lens array and an optical diffuser.

Each optical component stack in optical component stack array 110 includes a display device, such as display device 150, and a light delivery system, such as light delivery system 160. In some embodiments, the display devices may include emissive display devices. In some embodiments, the display devices may include non-emissive display devices. In some embodiments, light delivery system may be a relay lens. Optical component stack array 110 is configured to deliver the multiple images generated by the associated display devices as a single, relatively seamless image at the image plane of imaging optics 140, which is coincident with the upper surface of optics bridge 130 as illustrated in FIG. 1.

In some embodiments, such as the embodiment illustrated in FIG. 1, the outer edge of optics bridge 130 may be substantially aligned with the outer surface of outer walls 122. In other embodiments, the outer surface of the optics bridge may extend beyond the outer surface of the outer walls of the display module. The optics bridge may be supported by the outer walls and vertical supports via cutouts in the lower surface of the optics bridge configured to fit over tabs or lips included in the upper portion of the outer walls and or vertical supports.

In some embodiments, optics bridge 130 may include a single layer of transparent material. In other embodiments, the optics bridge may include multiple layers of transparent materials sandwiched together. In some embodiments, the material making up optics bridge 130 may be a homogeneous composition. In other embodiments, the material making up optics bridge 130 may be an inhomogeneous composition. In some embodiments, the optics bridge may function as an optical diffuser for imaging optics 140.

Optics bridge 130 simultaneously allows relayed light from the optical component stacks to pass through the optical bridge and mechanically support the imaging optics for the display module. In the case of published U.S. Pat. App. 2008/0144174 a lens array is supported by fiber bundles that form the light delivery system. In this manner the light is delivered directly to the imaging plane. There are no obstructions that would prevent light from reaching the edge of the imaging plane. In the presently disclosed apparatus, the imaging optics are not directly supported by the light delivery system. The thickness of optics bridge 130 may be selected so that light entering the lower surface proximate to the outer wall of the housing may pass through to the upper surface of the optics bridge without being substantially blocked. This allows the image plane to extend to the edge of the outer walls of the display module and for the relayed light to reach the edge of the image plane, thereby permitting seamless imaging within the display module. This also permits multiple display modules to be combined to achieve a single seamless image by tiling the images from the multiple display modules.

Figure 2A:
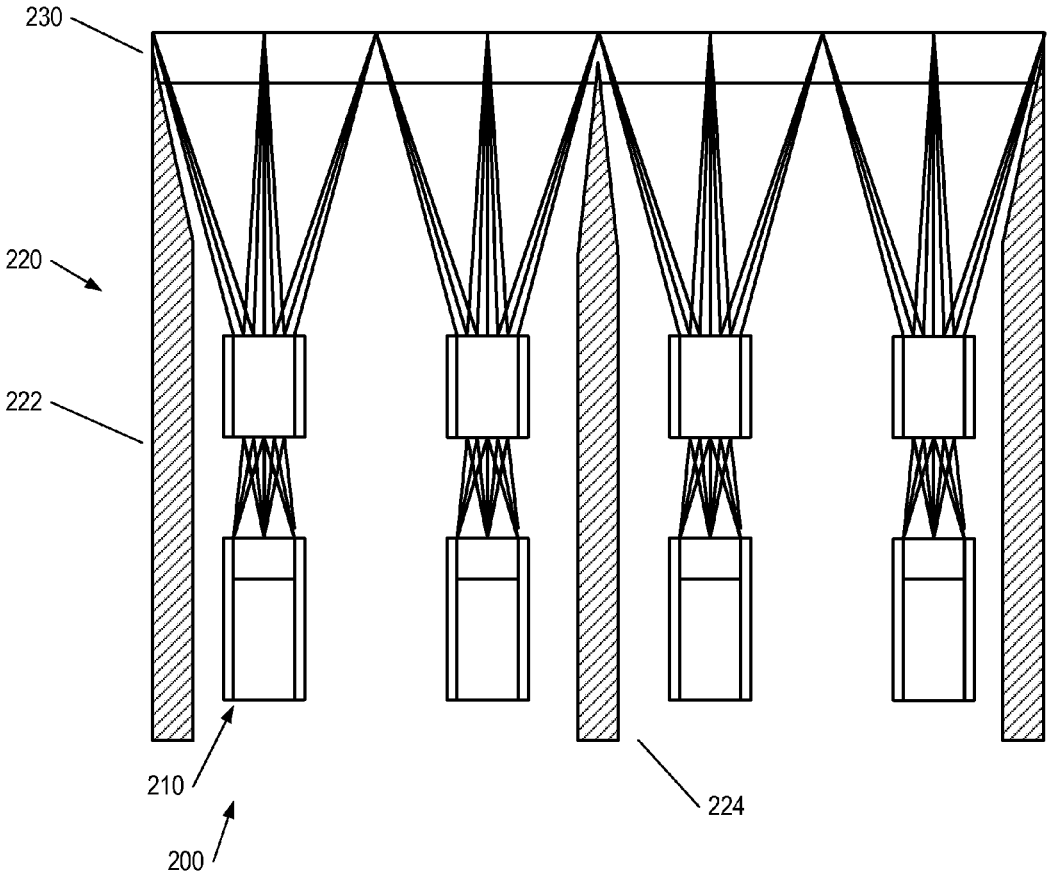
FIG. 2A is a cross-sectional representation of a display module having tapered outer walls and vertical supports, in accordance with some embodiments.

FIG. 2A is a cross sectional view of a display module having tapered outer walls and vertical supports, in accordance with some embodiments. Display module 200 includes optical component stack array 210 contained within housing 220. Housing 220 includes outer walls 222 and interior vertical supports 224. Optics bridge 230 is supported by the upper portions of outer walls 222 and vertical supports 224. The upper portions of outer walls 222 and vertical supports 224 may be tapered. The use of tapered outer walls and vertical supports facilitates the relay of unblocked light from the optical component stack array to the optics bridge. This also allows the design of a display module with a reduced footprint.

Figure 2B:
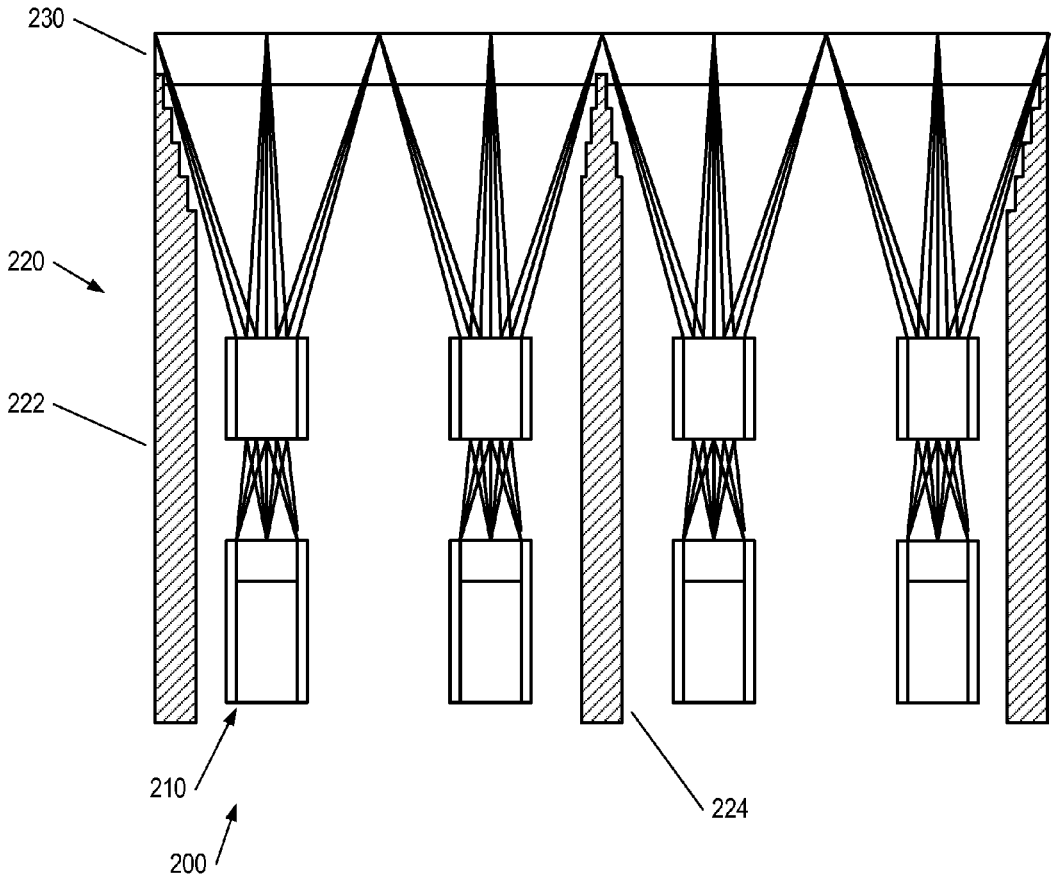
FIG. 2B is a cross-sectional representation of a display module having tapered outer walls and vertical supports that are stepped, in accordance with some embodiments.

FIG. 2B is a cross-sectional representation of a display module having tapered outer walls and vertical supports that are stepped, in accordance with some embodiments. As illustrated, the tapered portions of outer walls 222 and vertical supports 224 may be stepped. The use of stepping may reduce the possible effects of reflection artifacts. Although uniform stepping is illustrated in FIG. 2B, non-uniform stepping may be used in some embodiments. In other embodiments, the tapered portions of the outer walls and vertical supports may include dimpling, grooves, or similar techniques, in addition to, or in place of stepping to reduce reflection artifacts.

Figure 3:
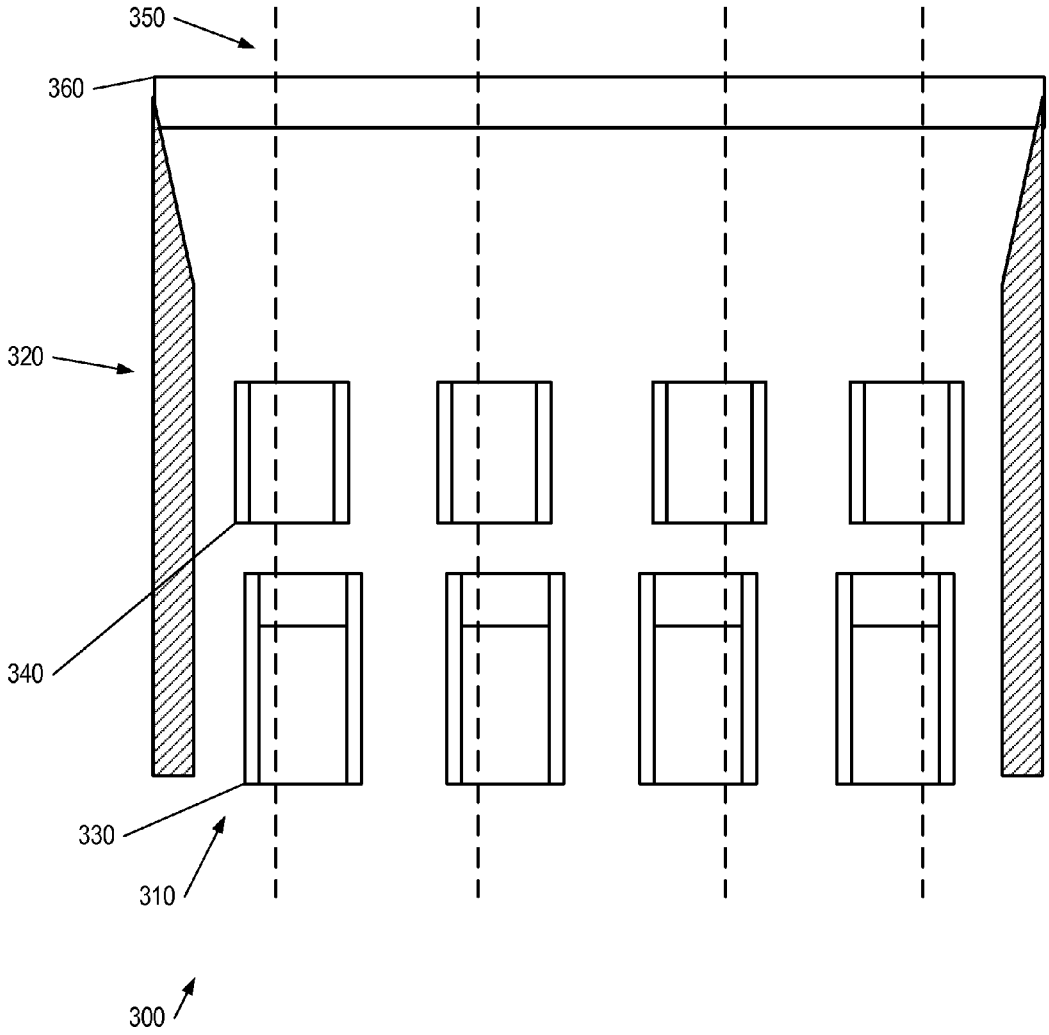
FIG. 3 is a cross-sectional representation of a display module illustrating lateral offset of the components within the optical component stacks, in accordance with some embodiments.

FIG. 3 is a cross sectional representation of a display module illustrating lateral offset of the components within the optical component stacks, in accordance with some embodiments. Display module 300 includes optical component stack array 310 contained within housing 320. Each optical component stack in optical component stack array 310 includes a display device, such as display device 330, and a light delivery system, such as light delivery system 340. Optical axes 350 are shown corresponding to each optical component stack in optical component stack 310.

For each optical component stack, the corresponding display device and light delivery system may be optically aligned along an optical axis associated with the optical component stack. This is generally illustrated in FIGS. 1 and 2 above. Each display device may be laterally offset by a first amount from its corresponding optical axis. The light delivery system associated with the display device may also be laterally offset by a second amount to maintain suitable imaging at the image plane. The offsets may be non-uniform. Use of the lateral offsets may permit the optical component stacks to be moved closer together.

Figure 4:
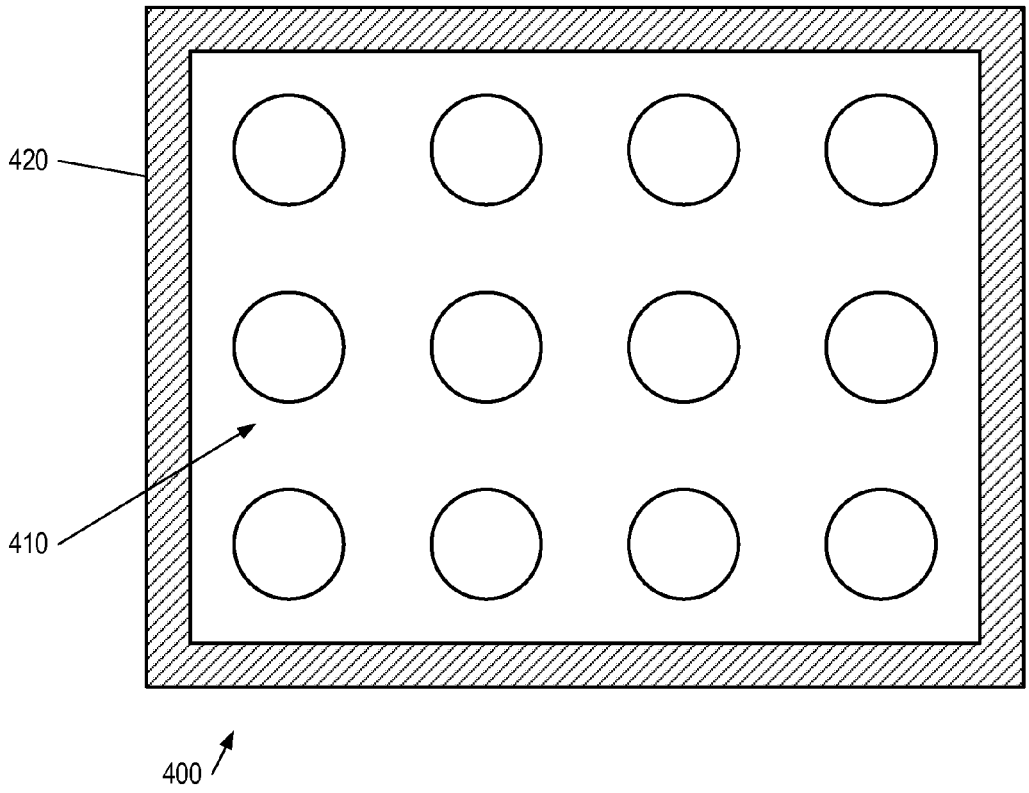
FIG. 4 is a top-down, cross-sectional representation of a display module, in accordance with some embodiments.

FIG. 4 is a top-down, cross-sectional representation of a display module in accordance with some embodiments. Display module 400 includes optical component stack array 410 contained within housing 420. The example illustrated in FIG. 4 illustrates a 4×3 array of optical component stacks. More generally, the array may be n ×m.

Figure 5:
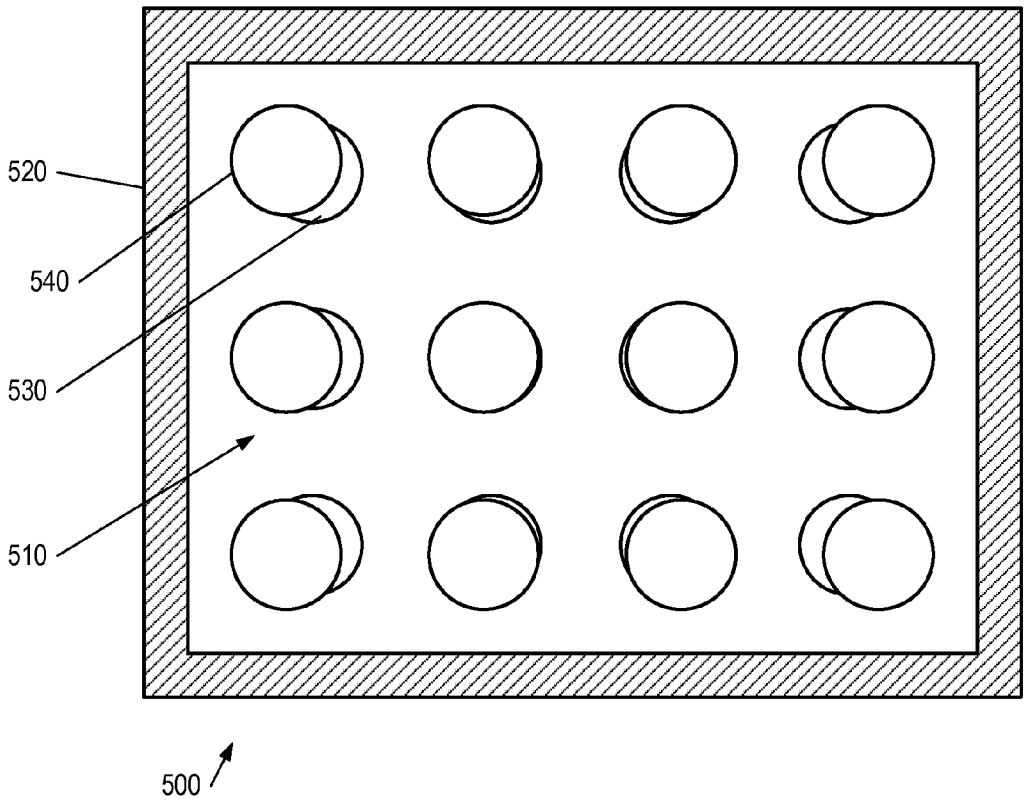
FIG. 5 is a top-down, cross-sectional representation of a display module illustrating lateral offset of the components within the optical component stacks, in accordance with some embodiments.

FIG. 5 is a top-down, cross-sectional representation of a display module illustrating lateral offset of the components within the optical component stacks, in accordance with some embodiments. Display module 500 includes optical component stack array 510 contained within housing 520. Each optical component stack in optical component stack array 510 includes a display device, such as display device 530, and a light delivery system, such as light delivery system 540. Each display device may be laterally offset by a first amount from its corresponding optical axis. The light delivery system associated with the display device may also be laterally offset by a second amount to maintain suitable imaging at the image plane. The offsets may be non-uniform. In some embodiments, the offsets for the display device and the light delivery system may be in the same direction.

Figure 6:
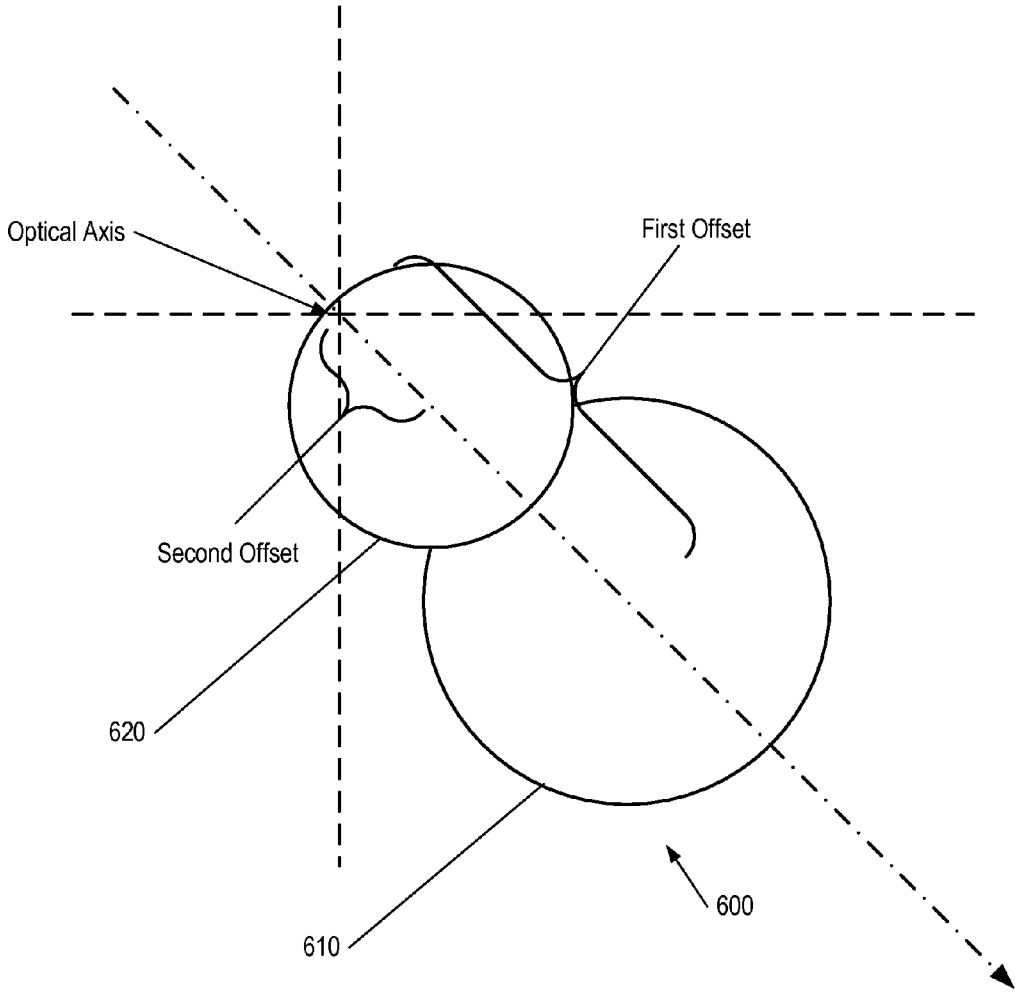
FIG. 6 shows a close-up view of the lateral offsets of the display device and light delivery system within an optical component stack, in accordance with some embodiments.

FIG. 6 shows a close-up view of the lateral offsets of the display device and light delivery system within an optical component stack, in accordance with some embodiment. Optical component stack 600 includes display device 610 and light delivery system 620. Display device 610 is shown radially displaced from the optical axis by a first offset along a first direction. Light delivery system 620 is shown radially displaced from the optical axis by a second offset along a second direction. In the illustrated embodiment, the first direction and second direction are the same. In some embodiments, the second offset is selected to be proportional to the first offset.

Figure 7A:
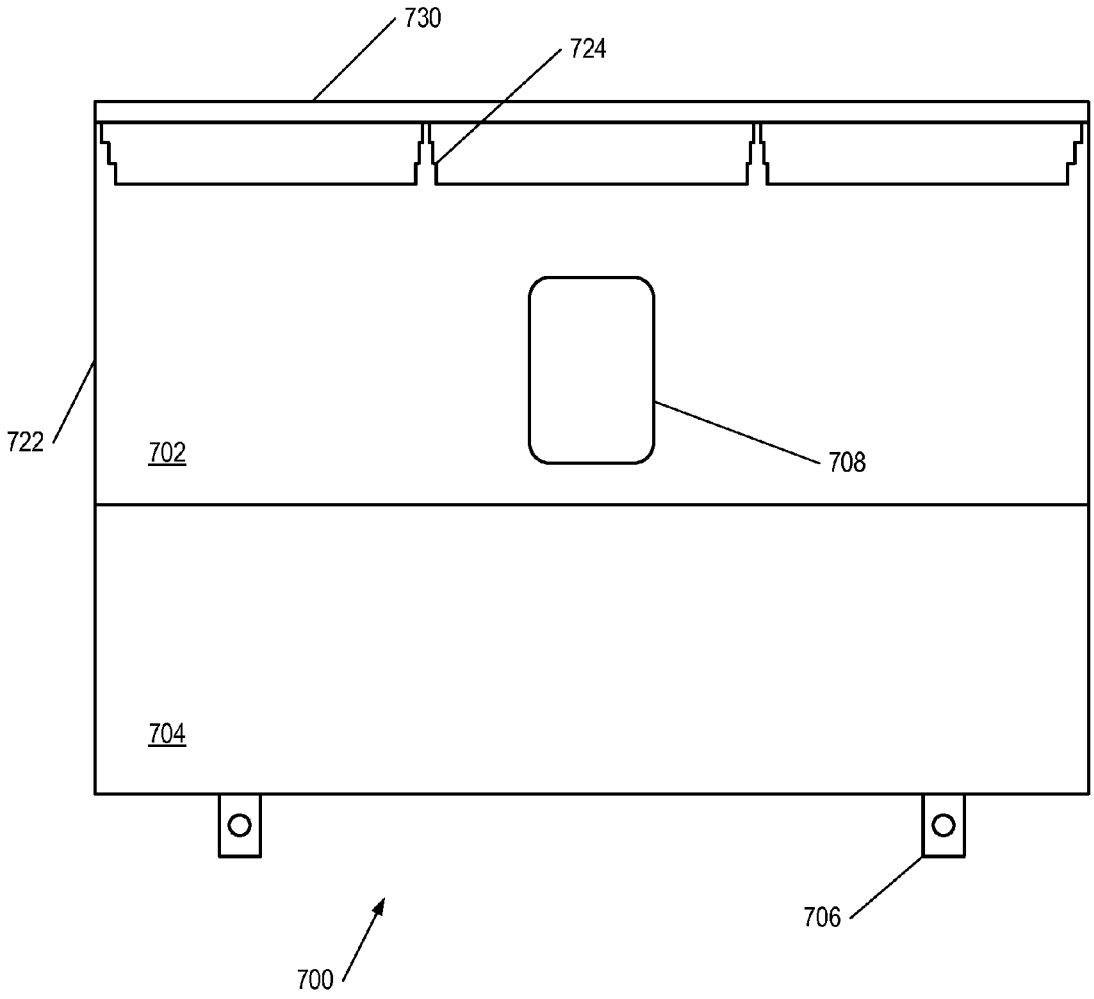
FIG. 7A is a front view of a display module, in accordance with some embodiments.
Figure 7B:
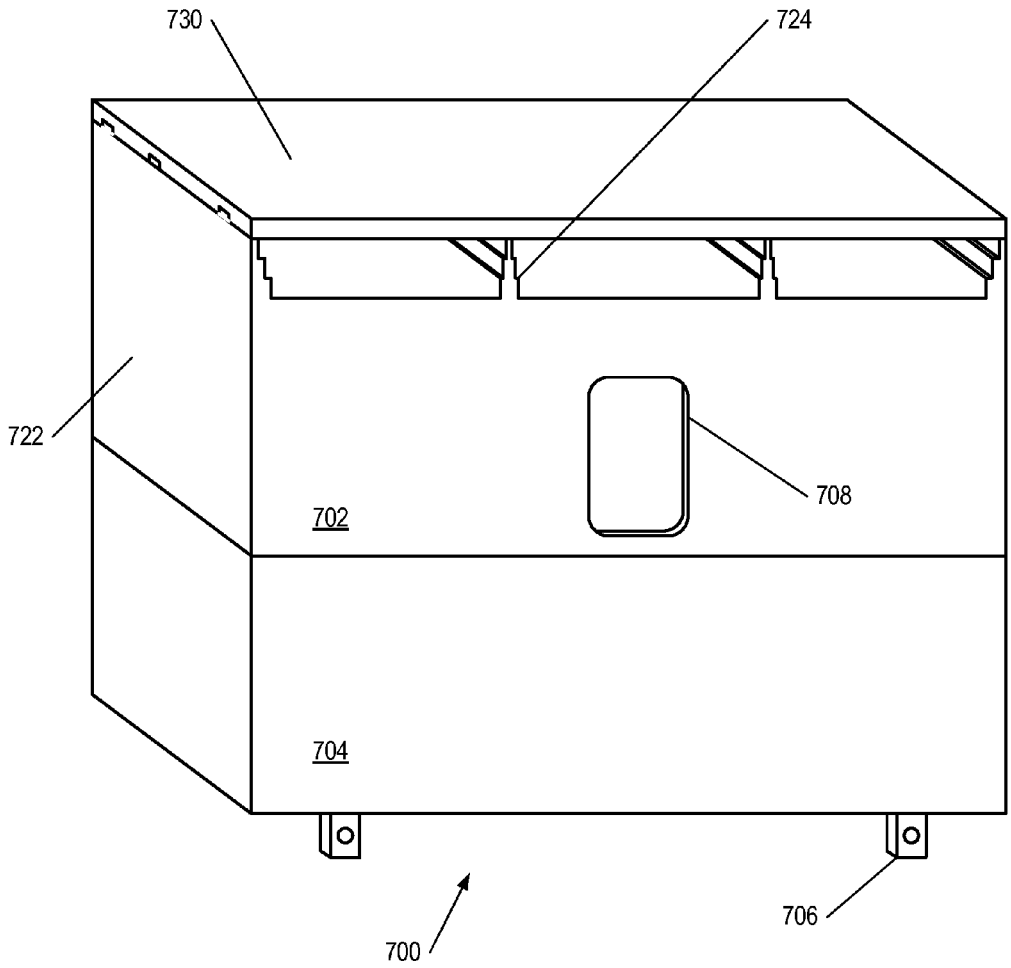
FIG. 7B is an external view of a display module, in accordance with some embodiments.

FIGS. 7A and 7B illustrate additional aspects of the presently disclosed apparatus. FIG. 7A is a front view of a display module, in accordance with some embodiments. Display module 700 may include upper section 702 and lower section 704. In some embodiments, the display devices and light delivery systems housed within display module 700 may be mounted within the separate sections. These sections may then be stacked, resulting in the optical component stacks. The outer walls of the lower and upper sections combine to form the outer walls of the display module. Mounting brackets 706 may be attached to lower section 704 to allow attachment to additional display module components, such as those containing the computer processing units that generate the 2D imaging data that is provided to the display devices.

FIG. 7B is an external view of a display module, in accordance with some embodiments. In some embodiments, the outer walls of the housing for a display module, such as display module 700, may include one or more cutouts, such as cutout 708, which allow air to circulate within the display module. Additionally, in some embodiments, the upper portion of the outer walls need not continuously be in contact with the optics bridge. This is illustrated in FIG. 7B, which shows the upper portion of outer walls 722 in contact with optics bridge 730 along opposite edges of the optics bridge. Vertical supports 724 provide additional support for optics bridge 730.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

The benefits and advantages that may be provided by the present invention have been described above with regard to specific embodiments. These benefits and advantages, and any elements or limitations that may cause them to occur or to become more pronounced are not to be construed as critical, required, or essential features of any or all of the claims.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention as detailed within the following claims.

The invention claimed is:

1. A display module comprising:

one or more outer walls, wherein the one or more outer walls are configured to house an array of optical component stacks, wherein the optical component stacks are within the one or more outer walls, wherein the one or more outer walls are configured to support a transparent support structure spanning the array of optical component stacks, and wherein an upper portion of the one or more outer walls in contact with the transparent support structure is tapered.

2. The display module of claim 1, wherein the tapering of the upper portion of the one or more outer walls is stepped.

3. The display module of claim 1, further comprising:

one or more vertical supports intermediate the array of optical component stacks, wherein the one or more vertical supports are configured to support the transparent support structure, and wherein an upper portion of the one or more vertical supports in contact with the transparent support structure is tapered.

4. The display module of claim 3, wherein the tapering of the upper portion of the one or more vertical supports is stepped.

5. The display module of claim 1, wherein a lower surface of the transparent support structure is supported by the one or more outer walls and by the one or more vertical supports, wherein an upper surface of the transparent support structure is configured to support imaging optics associated with the display module, and wherein the upper surface of the transparent support structure coincides with an imaging plane associated with the display module.

6. The display module of claim 1, wherein each optical component stack within the array of optical component stacks comprises a display device and a light delivery system, wherein the display device is offset by a first amount from an optical axis associated with the optical component stack, and wherein the light delivery system is offset by a second amount from the optical axis.

7. A display module comprising:

one or more outer walls, wherein the one or more outer walls are configured to house an array of optical component stacks, wherein the optical component stacks are within the one or more outer walls, wherein the one or more outer walls are configured to support a transparent support structure, and wherein an upper portion of the one or more outer walls in contact with the transparent support structure is tapered.

8. The display module of claim 7, wherein the tapering of the upper portion of the one or more outer walls is stepped.

9. The display module of claim 7, further comprising:

one or more vertical supports intermediate the array of optical component stacks, wherein the one or more vertical supports are configured to support the transparent support structure, and wherein an upper portion of the one or more vertical supports in contact with the transparent support structure is tapered.

10. The display module of claim 9, wherein the tapering of the upper portion of the one or more vertical supports is stepped.

11. The display module of claim 7, wherein a lower surface of the transparent support structure is supported by the one or more outer walls and the one or more vertical supports, wherein an upper surface of the transparent support structure is configured to support imaging optics associated with the display module, and wherein the upper surface of the transparent support structure coincides with an imaging plane associated with the display module.

12. The display module of claim 7, wherein each optical component stack within the array of optical component stacks comprises a display device and a light delivery system, wherein the display device is offset by a first amount from an optical axis associated with the optical component stack, and wherein the light delivery system is offset by a second amount from the optical axis.

13. A display module comprising:

one or more outer walls, wherein the one or more outer walls are configured to house an array of optical component stacks, wherein the one or more outer walls support a transparent support structure spanning the array of optical component stacks, and wherein an upper portion of the one or more outer walls in contact with the transparent support structure is tapered; and one or more vertical supports intermediate the array of optical component stacks, wherein the one or more vertical supports are configured to support the transparent support structure, and wherein an upper portion of the one or more vertical supports in contact with the transparent support structure is tapered.

14. The display module of claim 13, wherein the tapering of the upper portion of the one or more outer walls is stepped, and wherein the upper portion of the one or more vertical supports is stepped.

15. The display module of claim 13, wherein a lower surface of the transparent support structure is supported by the one or more outer walls and the one or more vertical supports, wherein an upper surface of the transparent support structure supports imaging optics associated with the display module, and wherein the upper surface of the transparent support structure coincides with an imaging plane associated with the display module.

16. The display module of claim 13, wherein each optical component stack within the array of optical component stacks comprises a display device and a light delivery system, wherein the display device is offset by a first amount from an optical axis associated with the optical component stack, and wherein the light delivery system is offset by a second amount from the optical axis.

* * * * *